US005230244A

United States Patent [19]

Gilbert

[11] Patent Number: 5,230,244

[45] Date of Patent: Jul. 27, 1993

[54] FORMATION FLUSH PUMP SYSTEM FOR USE IN A WIRELINE FORMATION TEST TOOL

[75] Inventor: Gregory N. Gilbert, Houston, Tex.

[73] Assignee: Halliburton Logging Services, Inc., Houston, Tex.

[21] Appl. No.: 545,231

[22] Filed: Jun. 28, 1990

[51] Int. Cl.[5] ..... E21B 47/00

[52] U.S. Cl. ..... 73/155

[58] Field of Search ..... 73/152, 155

[56] References Cited

U.S. PATENT DOCUMENTS

| | | | |
|---|---|---|---|
| 2,747,401 | 5/1956 | Doll | 73/151 |
| 3,289,474 | 12/1966 | Smith | 73/155 |
| 3,611,799 | 10/1971 | Davis | 73/155 |
| 4,416,152 | 11/1983 | Wilson | 73/155 |
| 4,860,581 | 8/1989 | Zimmerman et al. | 73/155 |
| 4,962,665 | 10/1990 | Savage et al. | 73/155 |

*Primary Examiner*—Hezron E. Williams
*Assistant Examiner*—Michael Brock
*Attorney, Agent, or Firm*—William J. Beard

[57] ABSTRACT

The present disclosure is directed to a formation test tool having similar, even identical, fist and second test probes which have supported snorkels thereon. They extend from the tool into a particular formation. One serves as an inlet and the other serves an outlet so that fluid can be removed from the formation, directed through the tool body, and returned to the formation through the other of the two snorkels. The fluid flow passes a test instrument which detects changes indicative of reduced well fluid invasion in the connate formation. A test procedure is also set forth for testing this fluid.

6 Claims, 2 Drawing Sheets

FORMATION FLUSH PUMP SYSTEM FOR USE IN A WIRELINE FORMATION TEST TOOL

BACKGROUND OF THE DISCLOSURE

This disclosure sets out a method and apparatus for obtaining formation fluid delivered into a wireline supported formation test tool, and in particular a test tool which is able to perform segregated testing. That is, it achieves the goal of obtaining a fluid sample from the connate formation fluids and avoids mixtures with drilling mud filtrate. This is particularly useful in making test identification prior to sample collection.

Existing formation testers have a limited fluid storage capacity. They include typically two or three fluid collection tanks or chambers in them. Heretofore, attempts to obtain connate formation fluid have been implemented by first and second separated tests. The first test obtains a first sample which is more likely to be contaminated with filtrate from the drilling mud. It will be recalled that this type testing is normally carried out in open hole where the side wall of the borehole is covered by a mud cake. The mud cake is formed by separation of the mud into the mud cake and filtrate which penetrates many of the formations of interest. That is, the formation absorbs a portion of the drilling mud. The typical testing procedure involves the extension of a test probe against the side wall. It has a seal ring to perfect a seal so that the region adjacent the test probe is not eroded. Moreover, a snorkel is normally extended through the center of the seal to assure that the tip of the snorkel is drawing fluid from the formation at the depth of penetration. This may obtain the connate formation fluid, but always, there is the risk that filtrate will penetrate to that depth. In fact, some formations are able to accept filtrate for substantial depths into the formation. In any event, the filtrate may commingle with formation fluid and the first sample removed might be contaminated with the filtrate. Segregated tests have been performed in the past where a first sample is taken and stored in a first container or tank within the test tool, and then a second sample is taken and also stored but it is stored in a separate tank. If filtrate penetration into the formation is not excessive, the second sample may be sufficiently pure to represent fairly the connate fluid from the formation. Additional tests are difficult to implement. At most, only three containers can be typically included in the formation test tool. Where several test chambers must be filled, this then requires retrieval of the tool to empty the test chambers so that subsequent tests can be made. This also regrettably requires a return trip to the surface. Multiple trips can be used to perform multiple tests at a given formation, but it is hard to locate the test tool at the requisite horizons in multiple trips. Accordingly, segregated testing involves multiple trips of the test tool and it is not a good solution.

The present disclosure sets out an apparatus and a method of operation whereby a sample is taken from the formation and is tested to assure that invasion fluid did not commingle with the sample, and that the sample is the connate fluid from the formation. The present apparatus utilizes first and second separate test probes with separate snorkels, and they are arranged diametrically opposite one another. With one, a fluid sample can be taken from a formation, and with the other, a portion or all can be reinjected into the formation. The fluid sample is forced through the tool from the inlet snorkel so that the sample can be tested. The type of testing is variable; typically it can be tested for sound transmission, magnetic wave transmission, conductivity, or other factors. The test selected determines the presence of constituents known to be in the well fluids so that their absence substantially indicates greater recovery of connate formation fluids. To this end, the device can include sample storage containers or tanks. Testing devices are included also. Testing devices are connected between the separate snorkels which serve as inlet and outlet. The testing devices test recovered fluid as it is pumped through the tool. Once it is determined that the formation fluid has not been invaded, a valving system is operated so that storage tanks or containers in the tool can be filled. A pump is included so that fluid recovered from the inlet snorkel is directed through the tool and to the outlet snorkel for restoration to the formation.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
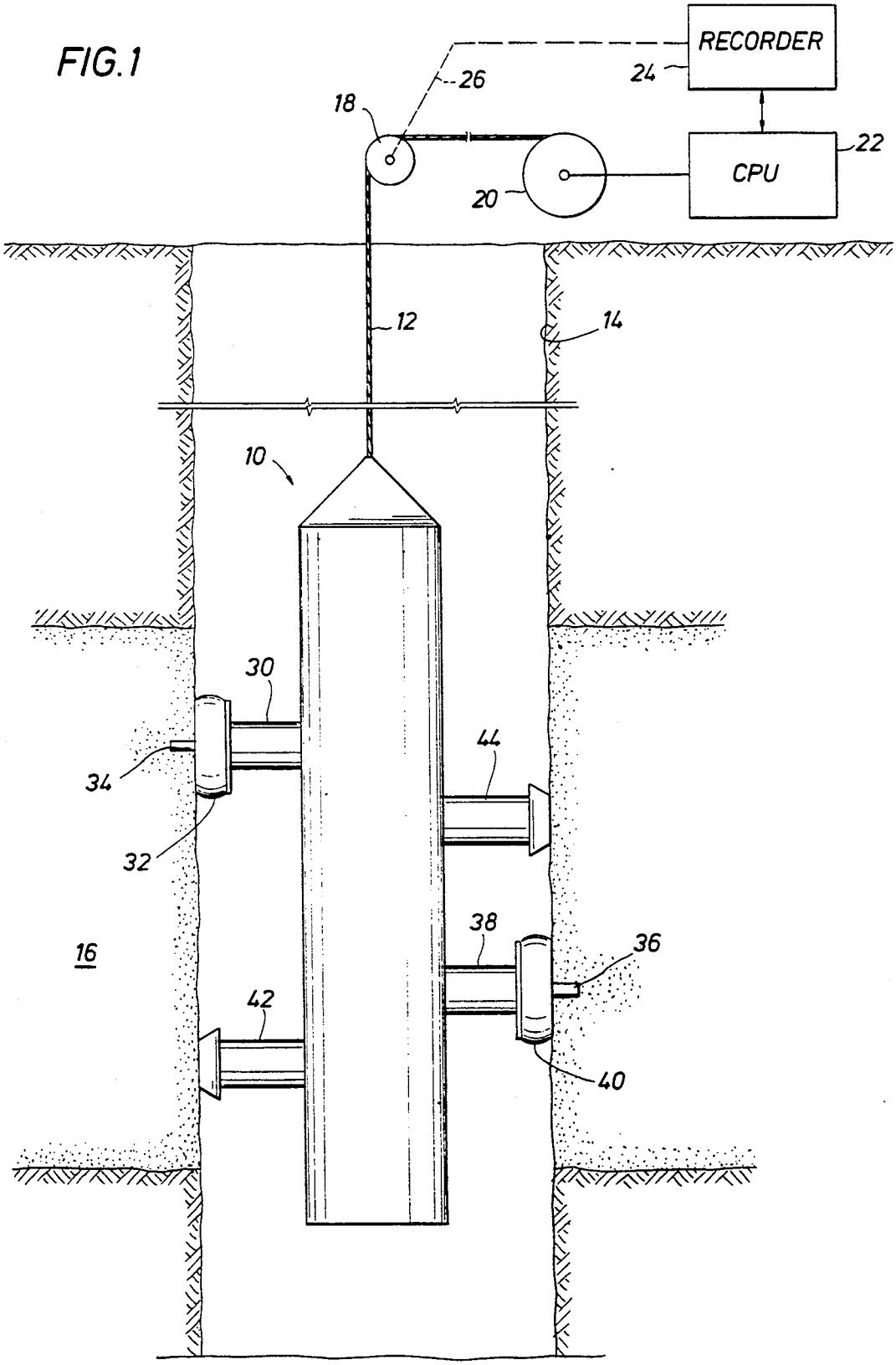
FIG. 1 shows a formation test tool in accordance with the present disclosure suspended in a well borehole for testing formation fluid from an adjacent formation.

Attention is directed first to FIG. 1 of the drawings where a formation test tool 10 in accordance with the present disclosure is supported in a well borehole from a logging cable 12. The well is quite deep, and is typically open hole at this stage of the proceedings. Accordingly, the numeral 14 identifies the well. There is a mud cake built up on the side wall of the well which is formed of separated drilling fluid which is pumped into the well. The mud cake includes the particles of the drilling fluid while filtrate of the drilling fluid soaks into the adjacent formations. The numeral 16 identifies a formation to be tested with the present invention. The logging cable 12 extends to the surface and passes over a sheave 18 and is stored on a drum 20. The cable is spooled on the drum. The conductors in the cable connect with a CPU 22. This delivers data of importance to the surface so that it can be analyzed. Moreover, the data that is received is also supplied to a recorder 24. The events observed in the well are recorded as a function of depth, the depth being furnished by a mechanical or electronic depth measuring device 26.

The formation test tool 10 is housed in an elongate body. The body encloses one or more storage tanks or containers. Also, hydraulic circuitry is included in the tool for extension of four members. The tool 10 is similar to known formation test tools in that it provides for a test probe which extends toward the side wall, abutting the side wall in a sealing fashion, and extending a snorkel. FIG. 1 shows a test probe 30 which supports a seal ring 32 at the outer end, and a snorkel 34 extends into the formation. The snorkel has a tip which is open to receive fluid from the formation. In this aspect, the test probe and snorkel are of conventional construction to the devices used heretofore. The present apparatus, however, differs in that a second snorkel is included at 36, and it is supported on a similar test probe 38 having a sealing ring 40. The second snorkel 36 is deployed on the opposite side of the tool. In the preferred embodiment, the two snorkels are able to extend to the formation 16 and achieve fluid communication with the formation. The present apparatus departs from teachings heretofore by incorporating two snorkels and using them to accomplish connection at two different locations with the formation 16.

Preferably, one is above the other. This would ordinarily cause the tool 10 to rotate on snorkel extension. To reduce the tendency for rotation, the system also includes backup systems 42 and 44. They operate as backup shoes known heretofore. Again, however, there is a difference in that two are included and they are preferably located in a common plane with the two snorkels mentioned and also are spaced along the length of the tool. Thus, they counteract rotational forces otherwise arising from the use of offset snorkels. The pistons 42 and 44 assure that the logging tool 10 will make a proper connection with the formation 16 while holding the tool substantially vertical to assure full insertion of the snorkels to the required depth in the formation to penetrate the mud cake and to obtain samples which are more likely free of filtrate contamination. The test procedure of the present apparatus utilizes the foregoing apparatus in the extended position. For retrieval from the well, the extended components are retracted so that the streamlined cylindrical tool body can be easily retrieved.

Figure 2:
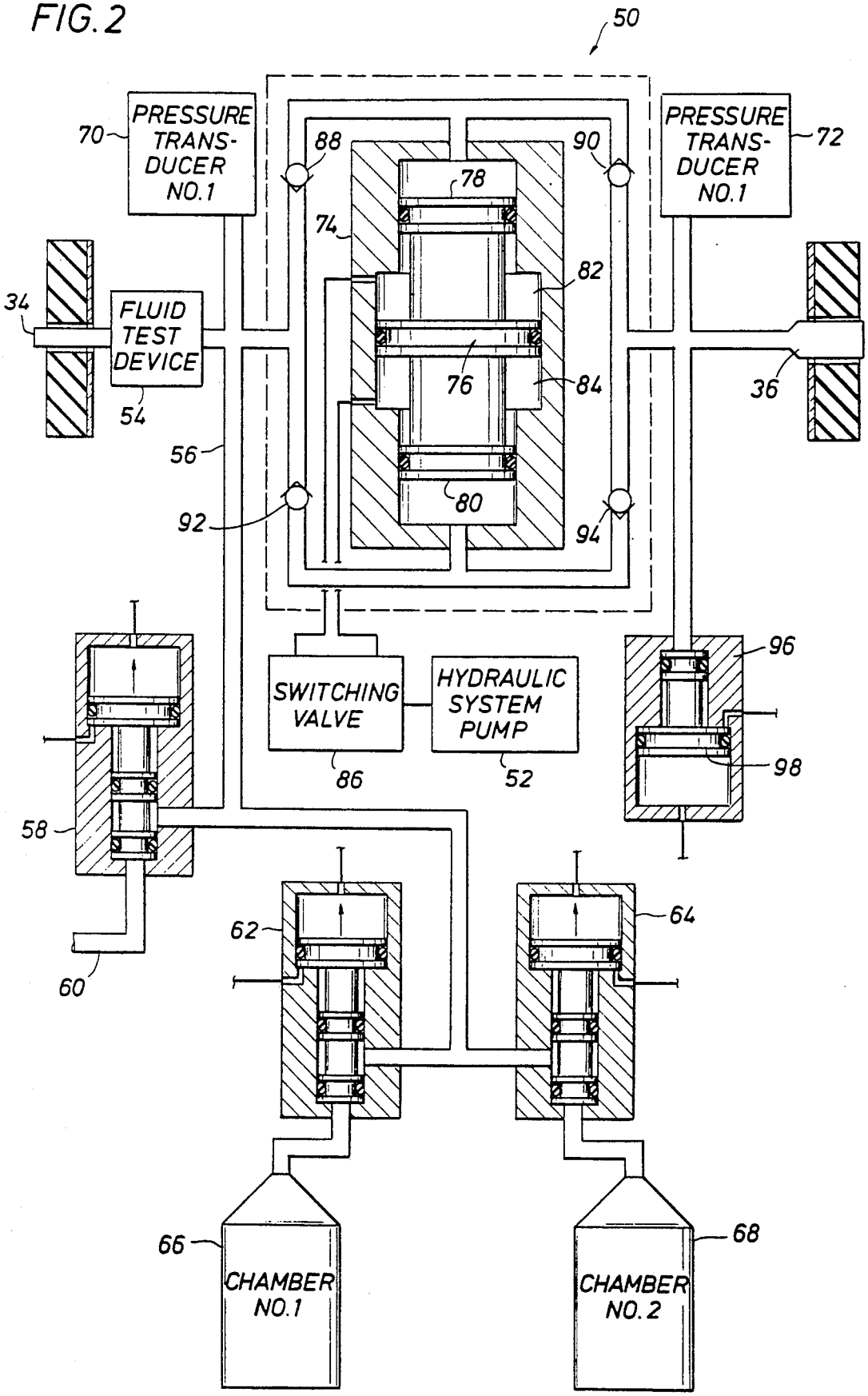
FIG. 2 is a schematic of the hydraulic components involved in the present apparatus and particularly shows inlet and outlet snorkels cooperative with a pump mechanism and appropriate valves and supply lines to fill storage sample chambers.

Going now to FIG. 2 of the drawings, the numeral 50 identifies the hydraulic circuit shown in FIG. 2. It includes a hydraulic system pump 52 which furnishes high pressure hydraulic fluid for operation of various components. The system also includes the snorkel 34 which will be denoted as the inlet snorkel. It is preferable that the snorkel 34 serve as the inlet because it is higher or above the other snorkel 36. The snorkel 36 is the outlet. Again, the two snorkels function in the same fashion but they are connected differently in the hydraulic system as will be described. Accordingly, the snorkel 34 is the inlet. Also, it should be noted that the outlet snorkel 36 is larger in diameter. This provides a greater fluid flow area at the outlet than at the inlet snorkel 34.

The system includes the following components for handling sample flow. Sample from the inlet 34 is introduced through a fluid test device 54. The fluid test device 54 performs one or more tests. For instance, an acceptable device for detection of a change in fluid has terminals connected to measure resistivity or conductivity of the fluid between the terminals. The fluid test device 54 delivers the inlet fluid to a main line 56. The main line 56 connects with an equalizing valve 58. The equalizing valve 58 is required to equalize the pressure between the front and back sides of the packer arrangements 32 and 40 during retraction of the tool. The equalizing valve opens to the tool exterior at an outlet port 60. Although not shown in FIG. 2, the hydraulic system which includes the hydraulic pump 52 and valving 86 is pressure balanced by means of a separate pressure compensating piston. (The hydraulic reservoir is compensated to hydrostatic pressure.) The hydraulic system operates at pressure levels determined by the ambient pressure on the exterior of the tool. The main line 56 delivers formation fluid to similar first and second sample chamber seal valves 62 and 64. The valves 62 and 64 connect with storage chambers 66 and 68. First one is filled and then the other can be filled. Their operation is typified by that found in various patents assigned to the common assignee of the present disclosure.

The present system additionally includes pressure sensors 70 and 72. The pressure transducer 70 is isolated so that it can measure the pressure at the inlet 34 while the pressure sensor 72 is isolated to measure the pressure at the second snorkel 36. Recall that the snorkels are similar in construction, but they function at different portions of the circuitry and are used for different purposes.

Formation fluid is introduced to the main line 56. It then is delivered to a pump 74. The pump 74 has a piston 76 which has an upper face 78 and a lower face 80. The two faces 78 and 80 are isolated in separate chambers. An additional chamber is included for hydraulic power. The chamber is divided by an enlargement on the piston 76, the enlargement defining an upper pump chamber 82 and a similar pump chamber 84 on the opposite side of the enlargement. The chambers 82 and 84 connect with a switching valve 86. The pump 52 provides fluid under pressure which is switched for delivery to the chambers 82 and 84 so that the piston 76 is reciprocated. Also included in the system is the pretest chamber 96. The pretest chamber 96, which includes a double acting piston 98, connects with the sample line 56 at the outlet of the pump 74. Once both packers 32 and 40 are extended against the formation, pretest chamber 96 is used to determine if effective seals have been established as well as to obtain formation pressure measurements and relative permeability indications.

The system further includes four check valves which are identified at 88, 90, 92 and 94. The main line 56 connects the inlet snorkel 34 with the outlet snorkel 36 through the four check valves as illustrated, and also connect with the double acting pump 74.

PUMPING ACTION AND FLUID FLOW IN THE HYDRAULIC SYSTEM

In FIG. 2 of the drawings, operation of the pump will be set forth first. The switching valve 86 is switched to reciprocate the piston 76. Pressurized fluid is delivered first to the chamber 82 and then to the opposite chamber 84 and this is reversed periodically to provide a pumping stroke to the equipment. Assume for purposes of description that the piston 76 is driven downwardly. If so, the upper chamber at the face 78 is expanded. When it expands, the chamber is filled. This requires fluid to flow through one of the check valves 88 and 90. The check valve 90 is biased so that it may not open for that action. Accordingly, when the piston 76 moves downwardly, the check valve 88 will open and fluid will be drawn into the main line 56 through the snorkel inlet 34.

To summarize, downstroke of the piston 76 opens the check valve 88 to admit fluid above the piston face 78. As that chamber is filled, the chamber at the opposite end of the pump is emptied. This occurs as fluid is forced by the piston face 80 out of the chamber. It cannot flow through the check valve 92 because that valve closes on the down stroke. It flows through the check valve 94 which is forced open, and is discharged through the outlet snorkel 36. When the piston 76 travels in the opposite direction, the check valves 92 and 90 operate so that fluid flow again is drawn in through the inlet snorkel 34 and fluid is pumped out of the pump through the outlet snorkel 36. This pumping action occurs on each stroke; each stroke is accompanied by intake flow and exhaust flow.

The foregoing describes how fluid can be taken through the tool 10 indefinitely. As the fluid flows into the tool, it is tested by the test device 54. The test device monitors the fluid flow to observe any changes in characteristics, and thereby indicates when connate fluid is available. At that time, the sample chamber seal valves 62 or 64 or both are operated to fill one or both of the chambers 66 and 68. When this occurs, the chambers are opened. They are maintained at a reduced pressure compared with formation pressure and fluid is directly sent through the main line 56 into the appropriate sample storage chamber.

METHOD OF OPERATION

The present formation test tool 10 is lowered into an uncased well to a requisite depth and located opposite a formation of interest. The formation 16 is illustrated in FIG. 1 so that testing can be undertaken. Assuming that the formation 16 has been invaded at least to some extent, and further assuming the fluid invasion commingles well fluid with the connate formation fluid, a sample is initially taken, and the sample is tested. Sample pumping can continue for any time span. As shown in FIG. 1, the sample is preferably taken out of the formation 16 on the left of FIG. 1 and the sample is returned to the formation on the right side of the borehole, see the lower right portion of FIG. 1. The formation 16 is in some measure closed off or isolated from the borehole by the mud cake which accumulates on the side wall of the borehole. Separate pressure sensors are provided to have pressure readings at two separate locations. Thus, one pressure sensor provides the pressure at the inlet snorkel and the other sensor at the outlet snorkel.

Once the formation test tool 10 is positioned adjacent to the formation of interest at 16, the packers 32 and 40 as well as back up members 42 and 44 are extended against the well borehole. The equalizing valve 58 is hydraulically coupled to the setting pistons 30, 38, 42 and 44 and is therefore closed due to packer and backup member extension. This action isolates the flow line 56 from the well bore fluids at the exterior of the tool 10: A pretest is then performed by moving the pretest piston 98 downwardly in the pretest assembly 96. The downward motion of the piston 98 creates a volumetric void at the upper face of the piston 98. The resultant drop in pressure at both the inlet snorkel 34 and outlet snorkel 36 is detected by pressure transducers 70 and 72 respectively. The pretest is performed to verify adequate packer seals around both the inlet and outlet snorkels and also to obtain both an accurate measurement of formation pressure and an indication of formation permeability. Once the pretest data indicates that adequate permeability exists in the formation 16, the pump 74 can be operated indefinitely to flush the formation at the face of the inlet snorkel 34 free of mud filtrate. This is indicated by the fluid test device 54. Once the formation has been sufficiently flushed, one or two formation fluid samples can be collected in the chambers 66 and 68 for retrieval to the surface. It should be noted that since both the inlet and outlet snorkels are in communication with a common formation 16, the fluid pressure at both snorkels is relatively equal. Therefore, the proposed flush pump system is not limited by any existing difference between hydrostatic pressure and the formation pressure.

Important preliminary steps involved in practice of the present method include the use of the backup pistons which extend from the tool. They are selectively controlled to provide extension in the illustrated fashion to avoid applying torque to the tool on snorkel extension. When the test is finished, the snorkels are withdrawn, the test probes are then retracted, and the tool can be retrieved. While the test probes are being retracted, the backup pistons are likewise retracted to return all four of the hydraulically powered members to the retracted position.

As a generalization, the formation 16 of interest will surround the uncased borehole. Assuming that the formation has sufficient permeability, the pressures at both sensors are equal after pulling fluid from the inlet snorkel. Pressure equalization accompanied by restoration of the inlet pressure to a level equal to the outlet pressure suggests that there is communication through the formation where the communication pathway encircles the borehole. This typically also indicates that the mud cake has accomplished its intended purposes, namely, that of isolating the borehole 14 from the formation. As a generalization, the mud pressure is kept equal to or greater than the formation pressure. That provides a fluid drive which tends to force drilling mud filtrate into the formation 16. Ideally, the fluid penetration is limited in substantial part by the mud cake which protects the formation from excessive fluid invasion from the borehole. Fluid identification is accomplished by the test device 54 connected with the main line. Typical measurements are resistivity or capacitance. A chromatograph likewise can be used.

One will assume that the formation pressure in the formation 16 is substantially equal so that any differential between one snorkel tip and the other will be dissipated rather quickly. In other words, the formation pressure is approximately the same at both snorkels. In this sense, the pump 74 is substantially independent of formation pressure and the hydrostatic borehole pressure. That is, the pumping action is independent of commonly encountered differentials between formation and hydrostatic pressure.

After testing has proceeded to the point where the specified storage chambers 66 and 68 are filled, the tool can then be retrieved to the surface. Retrieval is accomplished in a well known fashion, namely by retraction of the snorkels and the backup pistons. In addition, the sample chamber seal valves 62 and 64 are closed to isolate those chambers. The tool is then retrived to the surface on the logging cable. At the surface, the chambers are then emptied and subsequent testing is carried out for additional data indicative of formation porosity and permeability.

The foregoing is directed to the preferred embodiment of the structure and sets forth the preferred apparatus and a method of use thereof. While the foregoing is the preferred embodiment, the scope thereof is determined by the claims which follow.

What is claimed is:

1. A formation test device to be lowered in a well borehole which comprises:

(a) a tool body adapted to be supported in a well borehole adjacent to a formation of interest on a logging cable;

(b) an extendible snorkel having a fluid inlet for extension from said tool body to obtain a fluid sample from the formation of interest;

(c) a second and separate extendible snorkel having a fluid outlet for extension from said tool body to return a fluid sample to the formation of interest;

(d) pump means in said tool body operatively connected to said fluid inlet and also to said fluid outlet for pumping formation fluid from said fluid inlet through said tool body and to said fluid outlet;

(e) wherein said fluid outlet is larger in area than said inlet;

(f) valve means serially connected in the flow path from said fluid inlet to said fluid outlet to provide isolation of said fluid inlet and also of said fluid outlet;

(g) separate fluid inlet and fluid outlet testing means connected respectively to said fluid inlet and to said fluid outlet for making measurements of fluids at said fluid inlet and said fluid outlet respectively; and (g) storage chamber means in said tool body for receiving a sample connected through a controllable valve means enabling a selected portion of fluid flowing between said fluid inlet and said fluid outlet to be isolated and directed to said chamber means on operation of said valve means and wherein said controllable valve means additionally operates so that fluid flow can also be directed from said fluid inlet to said fluid outlet without storage of a sample.

2. The apparatus of claim 1 wherein said pump means comprises a double acting piston pump.

3. The apparatus of claim 2, wherein said pump and said valve means enable continuous fluid flow from said inlet.

4. The apparatus of claim 3, wherein said inlet is connected serially through a fluid test means.

5. The apparatus of claim 4, wherein said valve means comprises separate inlet and outlet check valves preventing back flow.

6. A formation test device to be lowered in a well borehole which comprises:

(a) a tool body adapted to be supported in a well borehole adjacent to a formation of interest on a logging cable;

(b) an extendible snorkel having a fluid inlet for extension from said tool body to obtain a fluid sample from the formation of interest;

(c) an extendible snorkel having a fluid outlet for extension from said tool body to return a fluid sample to the formation of interest;

(d) wherein said fluid outlet is larger in area than said inlet;

(e) pump means in said tool body operatively connected to said fluid inlet and also to said fluid outlet for pumping formation fluid from said fluid inlet through said tool body and to said fluid outlet;

(f) valve means serially connected in the flow path from said fluid inlet to said fluid outlet to provide isolation of said fluid inlet and also of said fluid outlet;

(g) separate fluid inlet and fluid outlet pressure measuring means connected respectively to said fluid inlet and to said fluid outlet for making pressure measurements of fluids at said fluid inlet and said fluid outlet respectively; and (h) storage chamber means in said tool body for receiving a sample connected through a controllable valve means enabling a selected portion of fluid flowing between said fluid inlet and said fluid outlet to be isolated and directed to said chamber means on operation of said valve means and wherein said controllable valve means additionally operates so that fluid flow can also be directed from said fluid inlet to said fluid outlet without storage of a sample.

* * * * *